US011459078B1

(12) United States Patent
Fregonese et al.

(10) Patent No.: US 11,459,078 B1
(45) Date of Patent: Oct. 4, 2022

(54) MARINE DRIVES AND PROPELLER DEVICES HAVING EXHAUST VENTING FOR ENHANCED REVERSE THRUST PERFORMANCE

(71) Applicant: Brunswick Corporation, Mettawa, IL (US)

(72) Inventors: Brian J. Fregonese, Fond du Lac, WI (US); Trevor George, Savoy, IL (US); Andrew C. Gunderson, Fond du Lac, WI (US); Jeffrey D. Reifsnyder, Fond Du Lac, WI (US); David M. Schmidt, Omro, WI (US)

(73) Assignee: Brunswick Corporation, Mettawa, IL (US)

( * ) Notice: Subject to any disclaimer, the term of this patent is extended or adjusted under 35 U.S.C. 154(b) by 16 days.

(21) Appl. No.: 17/109,536

(22) Filed: Dec. 2, 2020

(51) Int. Cl.
*B63H 21/32* (2006.01)
*B63H 1/20* (2006.01)

(52) U.S. Cl.
CPC ..... *B63H 21/32* (2013.01); *B63H 1/20* (2013.01)

(58) Field of Classification Search
CPC ... B63H 1/14; B63H 1/20; B63H 1/26; B63H 1/28; B63H 2001/286; B63H 21/32; B63H 21/34
USPC ..... 440/89 R, 89 A
See application file for complete search history.

(56) References Cited

U.S. PATENT DOCUMENTS 3,754,837 A 8/1973 Shimanckas
4,331,429 A * 5/1982 Koepsel ..... B63H 1/26 440/49
4,388,070 A * 6/1983 Kasschau ..... F01N 13/12 440/89 R
4,545,771 A 10/1985 Iio
4,778,419 A * 10/1988 Bolle ..... B63H 20/245 440/49
4,802,872 A 2/1989 Stanton
4,911,665 A 3/1990 Hetzel
5,549,455 A * 8/1996 Speer ..... B63H 20/245 416/140

(Continued)

FOREIGN PATENT DOCUMENTS

EP 2669183 12/2013
KR 101448576 B1 10/2014

*Primary Examiner* — Daniel V Venne

(74) *Attorney, Agent, or Firm* — Andrus Intellectual Property Law, LLP

(57) ABSTRACT

A propeller device has a propeller hub which is elongated along the rotational axis and a propeller blade which radially extends from the propeller hub. The propeller hub and propeller blade are configured so that when the propeller device is forwardly rotated, a first portion of the propeller hub on a first side of the propeller blade encounters a positive pressure and a second portion of the propeller hub on an opposite, second side of the blade encounters a relatively lower pressure or suction, and further so that when the propeller device is reversely rotated, the second portion of the propeller hub encounters a positive pressure and the first portion of the propeller hub encounters a relatively lower pressure or suction. An exhaust vent hole is located in the first portion of the propeller hub and configured to vent exhaust gases from the marine drive via the propeller hub as the propeller device is reversely rotated, thereby enhancing reverse thrust performance of the propeller device.

25 Claims, 5 Drawing Sheets

(56) References Cited

U.S. PATENT DOCUMENTS

| | | | |
|---|---|---|---|
| 5,916,003 | A | 6/1999 | Masini et al. |
| 6,234,853 | B1 | 5/2001 | Lanyi et al. |
| 6,375,528 | B1 | 4/2002 | Neisen |
| 6,511,354 | B1 | 1/2003 | Gonring et al. |
| 7,056,091 | B2 | 6/2006 | Powers |
| 7,267,068 | B2 | 9/2007 | Bradley et al. |
| 7,429,163 | B2 | 9/2008 | Patterson |
| 7,762,772 | B1 | 7/2010 | Alby et al. |
| 8,951,018 | B1 | 2/2015 | Calamia et al. |
| 2005/0191180 | A1 | 9/2005 | Powers |
| 2015/0217845 | A1 | 8/2015 | Hawkins |

* cited by examiner

MARINE DRIVES AND PROPELLER DEVICES HAVING EXHAUST VENTING FOR ENHANCED REVERSE THRUST PERFORMANCE

FIELD

The present disclosure relates to marine drives for propelling a marine vessel in water, and more particularly to marine drives and propeller devices for marine drives.

BACKGROUND

The following U.S. Patents are incorporated herein by reference:

U.S. Pat. No. 4,331,429 discloses a propeller having an exhaust discharge passage through the propeller hub and blades that are symmetrical in thickness about the nose-tail pitch line and symmetrical in plan form about a rake line. The propeller is particularly effective to increase reverse thrust when used with an outboard drive unit having exhaust gas relief passages.

U.S. Pat. No. 4,911,665 discloses an exhaust relief outlet provided in the lower end of a marine propulsion system lower unit for providing exhaust relief to an internal exhaust passage formed in the lower unit. The exhaust relief outlet is provided in the rear end of the lower unit and is disposed adjacent an area of restricted exhaust flow formed by converging walls of the internal exhaust passage. The exhaust relief outlet is located to discharge exhaust into the upper half of the path of the propeller as it rotates about a propeller shaft. The exhaust relief outlet both relieves exhaust pressure within the exhaust passage and provides controlled ventilation to the propeller for allowing increased acceleration and planning ability for a marine propulsion system.

U.S. Pat. No. 5,916,003 discloses a propeller device provided with vent apertures and plugs which fit into the vent apertures to be retained in position during use of the propeller device. The vent plugs are provided with openings therethrough so that fluids can flow from a region within a hub of the propeller device to a region proximate the outer cylindrical surface of the hub. The fluids flowing from the internal portion of the hub flow towards regions of low pressure near the propellers. The plugs can be changed to modify the size of the ventilation aperture without having to change the propeller device itself. One embodiment of the plug is provided with a moveable cover that closes the opening progressively in response to increasing rotational speed of the propeller device.

U.S. Pat. No. 6,234,853 discloses a docking system which utilizes the marine propulsion unit of a marine vessel, under the control of an engine control unit that receives command signals from a joystick or push button device, to respond to a maneuver command from the marine operator. The docking system does not require additional propulsion devices other than those normally used to operate the marine vessel under normal conditions. The docking or maneuvering system of the present invention uses two marine propulsion units to respond to an operator's command signal and allows the operator to select forward or reverse commands in combination with clockwise or counterclockwise rotational commands either in combination with each other or alone.

U.S. Pat. No. 6,511,354 discloses a multipurpose control mechanism which allows the operator of a marine vessel to use the mechanism as both a standard throttle and gear selection device and, alternatively, as a multi-axes joystick command device. The control mechanism comprises a base portion and a lever that is movable relative to the base portion along with a distal member that is attached to the lever for rotation about a central axis of the lever. A primary control signal is provided by the multipurpose control mechanism when the marine vessel is operated in a first mode in which the control signal provides information relating to engine speed and gear selection. The mechanism can also operate in a second or docking mode and provide first, second, and third secondary control signals relating to desired maneuvers of the marine vessel.

U.S. Pat. No. 7,267,068 discloses a marine vessel maneuvered by independently rotating first and second marine propulsion devices about their respective steering axes in response to commands received from a manually operable control device, such as a joystick. The marine propulsion devices are aligned with their thrust vectors intersecting at a point on a centerline of the marine vessel and, when no rotational movement is commanded, at the center of gravity of the marine vessel. Internal combustion engines are provided to drive the marine propulsion devices. The steering axes of the two marine propulsion devices are generally vertical and parallel to each other. The two steering axes extend through a bottom surface of the hull of the marine vessel.

U.S. Pat. No. 7,762,772 discloses a marine propeller is provided with a valve that progressively blocks exhaust flow into aerating relation with the blades of the propeller as the propeller rotational speed increases. A piston within a housing moves radially outwardly, in response to centrifugal forces, as the propeller increases in rotational speed. This movement progressively blocks an aperture that allows the flow of exhaust gas into the region of the propellers. In certain embodiments, a secondary flow path is allowed even when the piston has moved to its extreme outward radial position.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

According to the present disclosure, a propeller device is forwardly and reversely rotatable about a rotational axis to propel a marine drive forwardly and reversely in water, respectively. The propeller device has a propeller hub which is elongated along the rotational axis and a propeller blade which radially extends from the propeller hub. The propeller blade has a first blade face and an opposite, second blade face. The propeller hub and propeller blade are configured so that when the propeller device is forwardly rotated, the first blade face encounters a positive pressure and the second blade face encounters a relatively lower pressure or suction, and further so that when the propeller device is reversely rotated, the second blade face encounters a positive pressure and the first blade face encounters a relatively lower pressure or suction. An exhaust vent hole is formed through the propeller hub alongside the first blade face and configured to vent exhaust gases from the marine drive via the propeller hub as the propeller device is reversely rotated.

The propeller hub and propeller blade are configured so that when the propeller device is forwardly rotated, a first portion of the propeller hub on a first side of the propeller blade encounters a positive pressure and a second portion of the propeller hub on an opposite, second side of the blade encounters a relatively lower pressure or suction, and further so that when the propeller device is reversely rotated, the second portion of the propeller hub encounters a positive pressure and the first portion of the propeller hub encounters a relatively lower pressure or suction. The exhaust vent hole is formed through the first portion of the propeller hub and configured to vent exhaust gases from the marine drive via the propeller hub as the propeller device is reversely rotated.

Corresponding methods are also provided.

BRIEF DESCRIPTION OF THE DRAWINGS

The present disclosure is described with reference to the following Figures.

DETAILED DESCRIPTION

Figure 1:
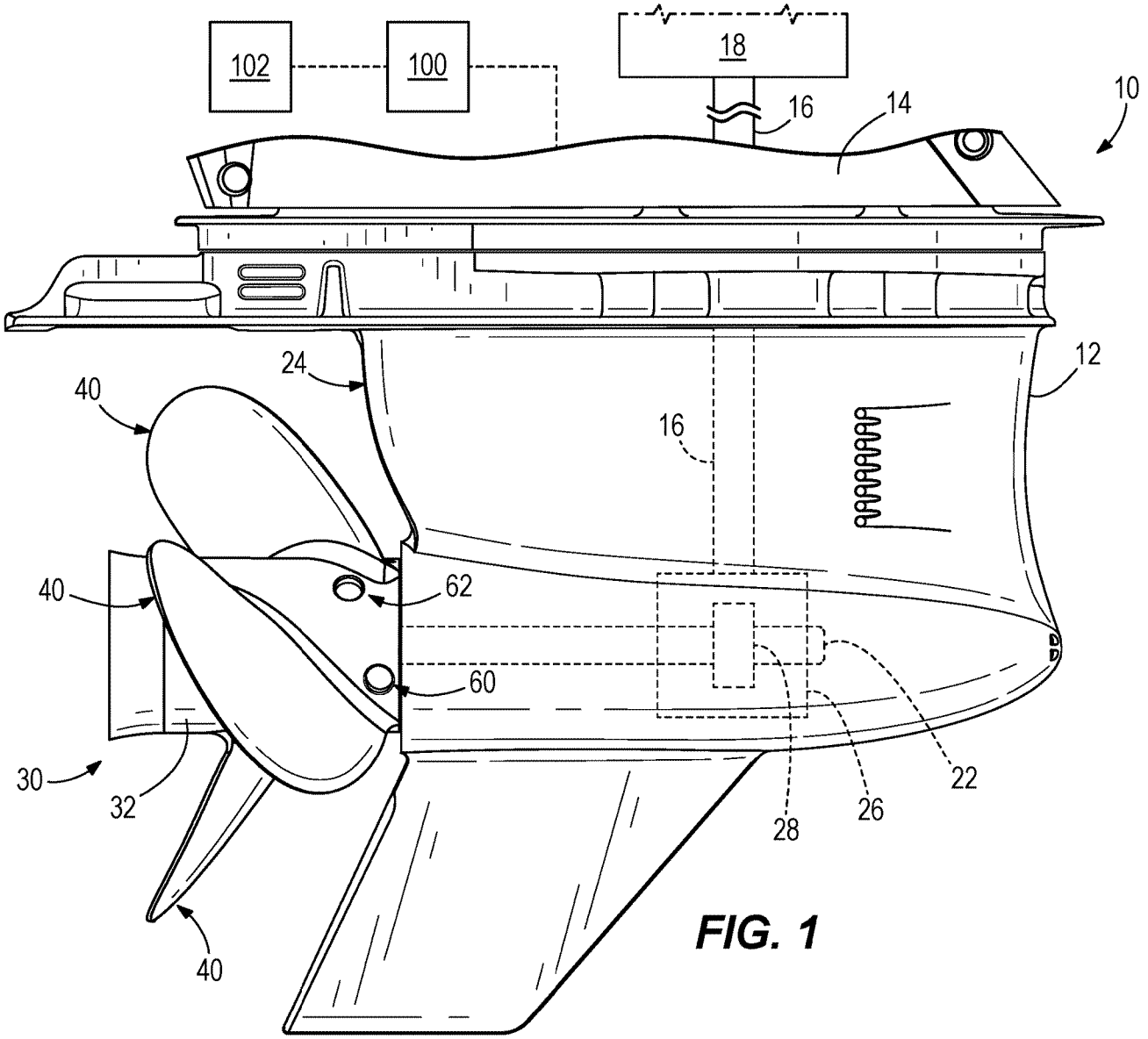
FIG. 1 is a starboard side view of a lower gearcase of a marine drive for propelling a marine vessel in water, the marine drive having a novel propeller device.

The present disclosure is a result of the inventors' efforts to improve the efficiency and thrust performance of marine drives, particularly marine drives having one or more propellers that are powered, at least in part, by an internal combustion engine. This includes but is not limited to outboard motors, stern drives, inboard drives, inboard/outboard drives, pod drives, and/or the like. Conventionally, such marine drives are configured to discharge exhaust gases from the engine into the water near the propeller(s), for example through a center-bore in the hub of the propeller(s) and/or one or more outlets formed in or above the gearcase, proximate to the propeller(s). See for example the above-incorporated U.S. Pat. Nos. 4,331,429; 4,911,665; 5,916,003; 7,762,772. See also the 2020 Verado outboard motor produced and sold by Mercury Marine, a division of Brunswick Corporation.

The present disclosure is also a result of the inventors' efforts to improve the efficiency and thrust performance of joystick-piloted systems incorporating the above-described marine drives. Such systems are well known in the art, examples of which are disclosed in the above-incorporated U.S. Pat. Nos. 6,234,853; 6,511,354; and 7,267,068.

It is known in the art to provide radial exhaust outlets through the hub of the propeller to facilitate improved acceleration when the marine drive is operated in forward gear, particularly in situations where the horsepower of the engine is not sufficient to otherwise meet a demand for sudden and prolonged forward acceleration (otherwise known as a "throttle stab"). See for example U.S. Pat. No. 5,916,003, which teaches propellers having exhaust ventilation holes through which exhaust gases are vented in a radially outward direction, alongside the propeller blades. The ventilation holes are particularly located where low-pressure zones are developed on the hub, behind the blades during forward rotation of the propeller. The exhaust gases are caused to pass from the propeller hub into the water within the annular volume described by the path of the propeller blades. The presence of the exhaust gases creates an environment through which it is easier for the propeller blades to move, thus facilitating quicker acceleration.

Through research and experimentation, the present inventors determined that discharge of exhaust gases to the water rearwardly of the propeller(s), for example via the center-bore in the hub of the propeller(s), can result in inefficiency, particularly when the propeller(s) are initially reversely rotated at low speeds in reverse gear. The present inventors also determined that discharge of exhaust gases, as taught in the '003 patent, can be counter-productive when implementing conventional joystick-piloting methods because reducing pressure along the pressure face of the propeller blades reduces efficiency when the propeller is operated at low speeds. The inventors found this to be particularly problematic in joystick-piloted systems, wherein changes in direction of rotation of the propellers is often sudden and at relatively low speeds. The presence of exhaust gases in the water rearwardly of the propellers and alongside the pressure face of the propeller blades interferes with responsiveness to a joystick command requiring a sudden reverse thrust.

The present disclosure is a result of the inventors' efforts to overcome these challenges, and particularly to provide marine drives and propeller devices that are more efficiently operated, for example via conventional joystick-piloting methods.

FIG. 1 depicts a marine drive 10 having a lower gearcase 12 and a driveshaft housing 14. A driveshaft 16 extends from the driveshaft housing 14 into the lower gearcase 12. The upper end of the driveshaft 16 is operatively coupled to a powerhead 18 configured to cause rotation of the driveshaft 16. The type of powerhead 18 includes an internal combustion engine 20. The type and configuration of the powerhead 18 can vary and can include any style of combustion engine, alone or in combination with an electric motor, for example in a hybrid configuration. A propeller shaft 22 laterally extends from the rearward side 24 of the lower gearcase 12. An angle gearset 26 operatively couples the lower end of the driveshaft 16 to the propeller shaft 22 such that rotation of the driveshaft 16 causes rotation of the propeller shaft 22. A clutch mechanism 28 located in the lower gearcase 12 is configured to control the direction of rotation of the propeller shaft 22, in particular such that rotation of the driveshaft 16 causes forward rotation of the propeller shaft 22 when the clutch mechanism 28 is placed in forward gear, and such that rotation of the driveshaft 16 causes reverse rotation of the propeller shaft 22 when the clutch mechanism 28 is placed in reverse gear. The type and configuration of the clutch mechanism 28 can vary, and in one example is a conventional dog-clutch. A novel propeller device 30 is coupled to the outer end of the propeller shaft 22 such that rotation of the propeller shaft 22 causes rotation of the propeller device 30, via for example a splined coupling, which in turn propels the marine drive 10 and associated marine vessel in water. The novel configuration of the propeller device 30 will be further described herein below.

Exhaust gases from the powerhead 18 are discharged, at least in part, to the water via the lower gearcase 12 and propeller device 30. More particularly, the lower gearcase 12 has internal passages that receive the exhaust gases from the powerhead 18 via the driveshaft housing 14. The exhaust gases are generally conveyed downwardly from the driveshaft housing 14 into the lower gearcase 12 and then transversely, laterally alongside the propeller shaft 22 and into the water via a through-bore 33 (see FIG. 2) extending through the propeller device 30.

Figure 2:
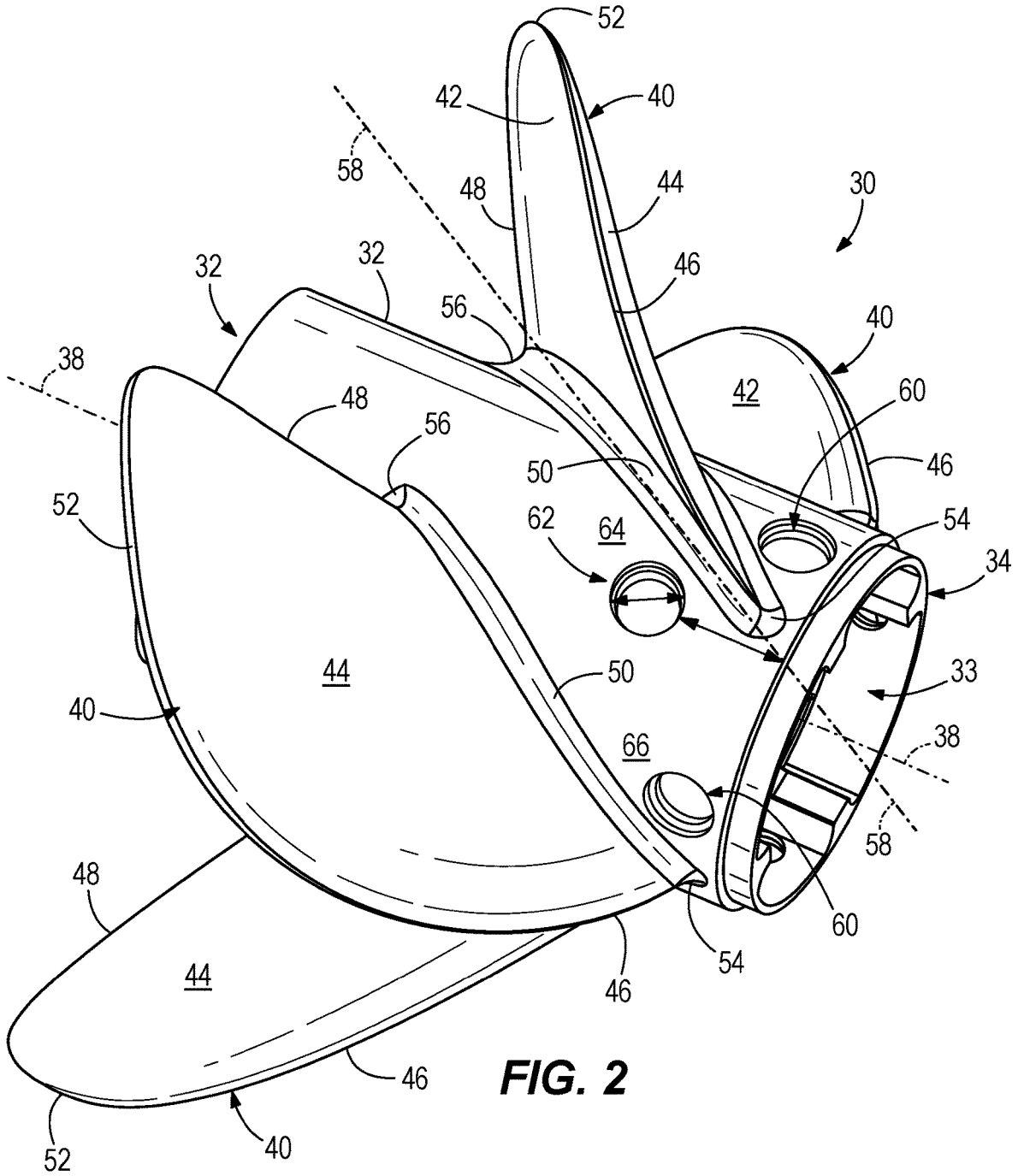
FIG. 2 is a starboard side perspective view of the propeller device.

FIG. 2 depicts the propeller device 30, which as explained herein above rotates forwardly and reversely with the propeller shaft 22 to propel the marine vessel in water. The propeller device 30 includes a centrally-located propeller hub 32, which extends from a forward end 34 to a rearward end 36 along a rotational axis 38 defined by the propeller shaft 22. A plurality of propeller blades 40 radially extend from and are spaced apart around the propeller hub 32. Each propeller blade 40 has a first blade face 42 and an opposite, second blade face 44. The propeller hub 32 and propeller blades 40 are configured so that when the propeller device 30 is forwardly rotated, the first blade face 42 encounters a positive pressure and the second blade face 44 of encounters a relatively lower pressure or suction. Further, when the propeller device 30 is reversely rotated, the second blade face 44 encounters a positive pressure and the first blade face 42 encounters a relatively lower pressure or suction. Each propeller blade 40 has a leading edge 46 and a trailing edge 48. The leading edge 46 is located forwardly of the trailing edge 48 relative to the marine drive 10. Each propeller blade 40 has a blade root 50 on the propeller hub 32 and a blade tip 52 distally located relative to the blade root 50. The blade root 50 extends from a forward root end 54 to a rearward root end 56 along a pitch line 58, which extends transversely to and intersects with the rotational axis 38 when viewed from the perspective shown in FIG. 1.

Optionally, as shown in FIGS. 1-2, the propeller device 30 includes exhaust vent holes 60 located alongside the propeller blades 40, particularly where low-pressure zones are developed on the propeller hub 32, behind the propeller blades 40 during forward rotation of the marine drive 10. In this regard, the propeller device 30 is configured in a conventional manner to achieve the functional advantages described in the above-incorporated '003 patent, particularly achieving improved acceleration in forward gear.

Referring to FIG. 2, the propeller device 30 has novel exhaust vent holes 62 formed in the propeller hub 32 alongside the respective first blade faces 42. The exhaust vent holes 62 extend to the through-bore 33 in the propeller hub 32 and thus are configured to vent exhaust gases from the through-bore 33 under certain operating conditions including, as further described herein below, when the propeller device 30 is reversely rotated. As further explained herein below, this feature was found by the present inventors to advantageously enhance reverse thrust performance of the propeller device 30 by removing a portion of the exhaust gases from the path of travel of the reversely rotating propeller blades 40. The exhaust vent holes 62 are interdigitated amongst the propeller blades 40. Each exhaust vent hole 62 is located alongside a respective first blade face 42 of a respective propeller blade 40, i.e. closer to the respective first blade face 42 than a respective second blade face 44 of an adjacent propeller blade 40.

The location of the exhaust vent holes 62 can vary from what is shown in FIGS. 1 and 2. In the illustrated example, the exhaust vent holes 62 are located alongside a respective blade root 50, closer to the forward end 34 of the propeller hub 32 than the rearward end 36. The exhaust vent holes 62 are located closer to the leading edge 46 of the propeller hub 32 than the trailing edge 48. The exhaust vent holes 62 are located forwardly of the location where the pitch line 58 intersects with the rotation axis 38, and closer to the forward root end 54 than the rearward root end 56. Thus, the exhaust vent holes 62 are configured to vent the exhaust gases forwardly of a majority of the propeller blade 40 as the propeller device 30 is reversely rotated and the marine drive 10 translates rearwardly, as further described herein below. The shape and size of the exhaust vent holes 62 can vary. In the illustrated example, the exhaust vent holes 62 are circular.

Referring to FIG. 2, the propeller device 30 is subjected to various pressures during forward and reverse rotation. As explained herein above, when the propeller device 30 is forwardly rotated, the first blade face 42 encounters a positive pressure and the second blade face 44 encounters a relatively lower pressure or suction. When the propeller device 30 is reversely rotated, the second blade face 44 encounters a positive pressure and the first blade face 42 encounters a relatively lower pressure or suction. It follows that when the propeller device 30 is forwardly rotated, a first portion 64 of the propeller hub 32 on a first side of each of the respective propeller blades 40 encounters a positive pressure and a second portion 66 of the propeller hub 32 on an opposite, second side of the respective propeller blade 40 encounters a relatively lower pressure or suction. When the propeller device 30 is reversely rotated, the second portion 66 of the propeller hub 32 encounters a positive pressure and the first portion 64 encounters a relatively lower pressure or suction. The exhaust vent hole 62 is advantageously formed through the first portion 64 of the propeller hub 32 so that the exhaust vent hole 62 vents exhaust gases from the through-bore 33 as the propeller device 32 is reversely rotated and the first portion of the propeller hub 32 encounters the lower pressure or suction.

Depending on various factors such as blade configuration, hub configuration, marine drive configurations, and the like, each of the first portions 64 of the propeller hub 32 naturally will comprise a certain smaller area of lowest pressure or suction on the propeller hub 32 when the propeller device 30 is reversely rotated. The present inventors determined that locating the exhaust vent hole 62 at this "area of lowest pressure or suction" will help encourage suction of the exhaust gases from the through-bore 33 during reverse rotation, thus providing the performance advantages discussed herein below. Further, each of the first portions 64 of the propeller hub 32 also naturally will comprise a certain smaller area of maximum pressure on the propeller hub 32 when the propeller device is forwardly rotated. The present inventors determined that locating the exhaust vent hole 62 at this "area of maximum pressure" will help retain the exhaust gases in the through-bore 33 during forward rotation, thus limiting interference with operation of the propeller device 30 during forward rotation.

Figure 3:
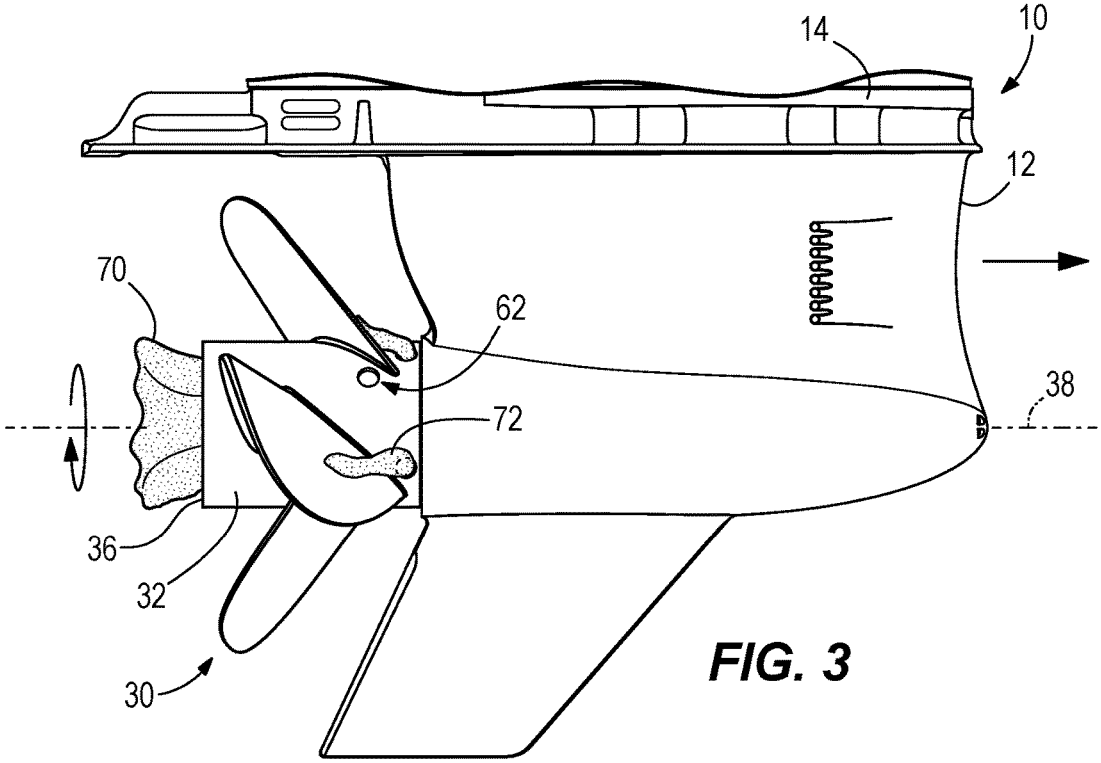
FIG. 3 is a starboard side view of the marine drive, showing initial forward rotation of the propeller device and initial discharge of exhaust gases during initial forward translation of the marine drive.
Figure 4:
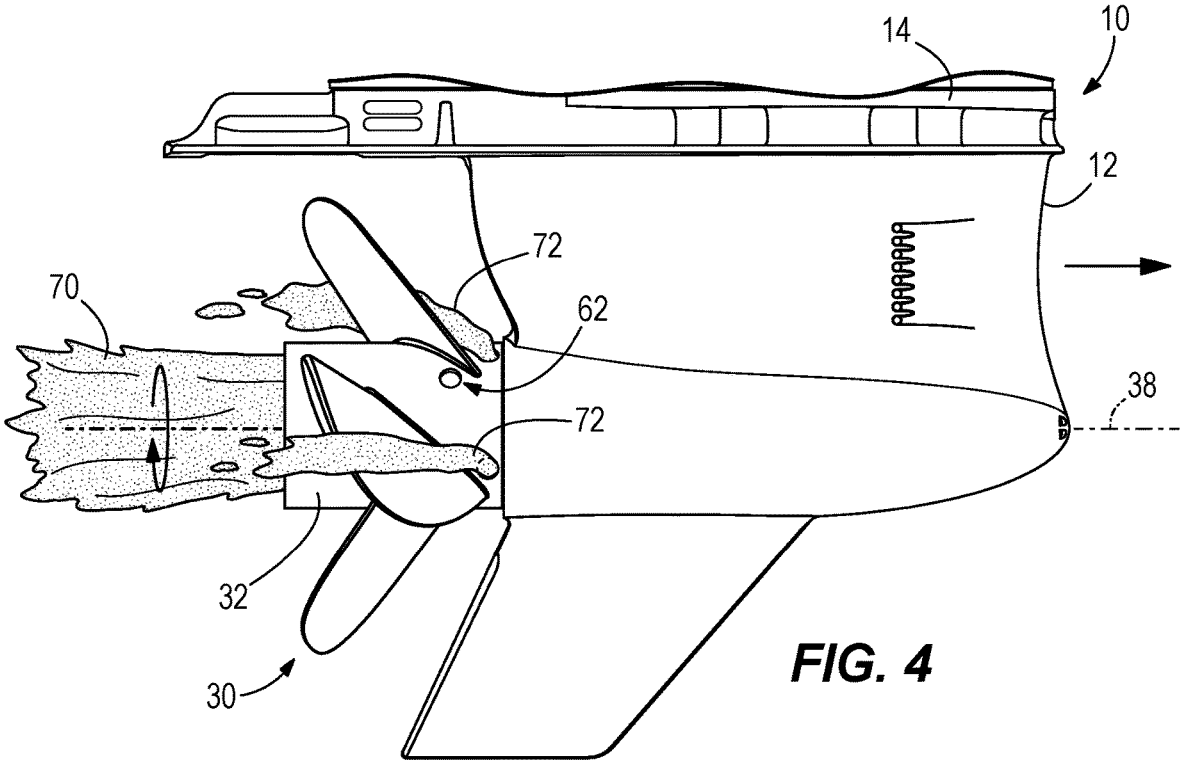
FIG. 4 is a starboard side view of the marine drive, showing continued forward rotation of the propeller device and continued discharge of exhaust gases during continued forward translation of the marine drive.

FIGS. 3 and 4 depict the marine drive 10 upon initial forward rotation of the propeller device 30 (FIG. 3) and upon further forward rotation of the propeller device 30 (FIG. 4). As described herein above, with reference to FIG. 2, forward rotation of the propeller device 30 increases fluid pressure on the first blade face 42 and on the first portion 64 of the propeller hub 32. Lower pressure or suction develops on the second blade face 44 and the second portion 66 of the propeller hub 32. As shown, a first portion of the exhaust gases 70 is discharged from marine drive 10 via the through-bore 33, out of the rearward end 36 of the propeller hub 32, aftwardly of the forwardly translating propeller device 30. A negative pressure in the water behind the propeller device 30 helps draw the first portion of exhaust gases 70 out of the through-bore 33. The low pressure or suction on the second blade face 44 and on the second portion 66 of the propeller hub 32 draws a second portion of the exhaust gases 72 out of the exhaust vent holes 60, thereby achieving the acceleration performance advantages taught in the presently-incorporated '003 patent. As shown, the increased pressure on the first portion 64 of the propeller hub 32 helps retain the exhaust gases in the through-bore 33 relative to the exhaust vent holes 62, more specifically causing the flow of exhaust gases to pass and not escape from the through-bore 33 via the exhaust vent holes 62.

Figure 5:
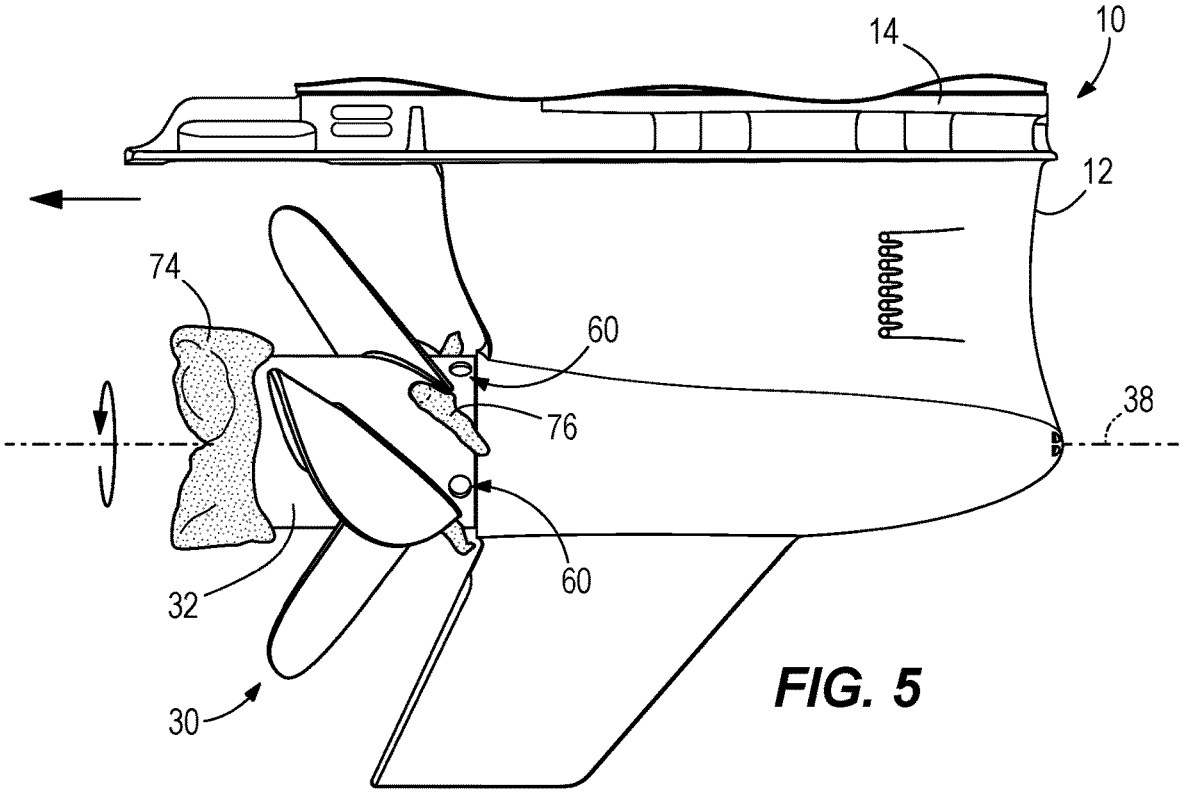
FIG. 5 a starboard side view of the marine drive, showing initial reverse rotation of the propeller device and initial discharge of exhaust gases during rearward translation of the marine drive.
Figure 6:
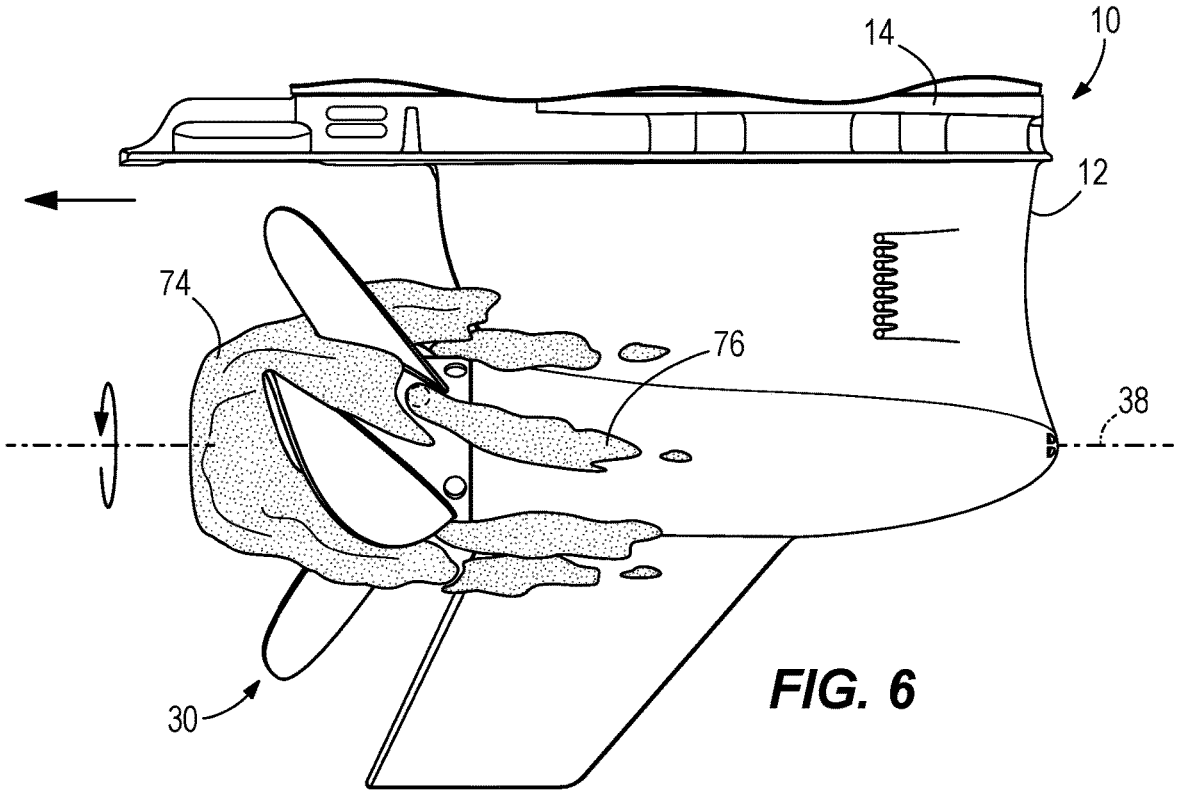
FIG. 6 is a starboard side view of the marine drive, showing continued reverse rotation of the propeller device and continued discharge of exhaust gases during continued rearward translation of the marine drive.

FIGS. 5 and 6 depict the marine drive upon initial reverse rotation of the propeller device 30 (FIG. 5) and upon further reverse rotation of the propeller device (FIG. 6). As described herein above, with reference to FIG. 2, reverse rotation of the propeller device 30 increases fluid pressure on the second blade face 44 and on the second portion 66 of the propeller hub 32. Lower pressure or suction develops on the first blade face 42 and on the first portion 64 of the propeller hub 32. As shown, a first portion of the exhaust gases 74 is forced from the marine drive 10 via the through-bore 33, out the rearward end 36 of the propeller hub 32. As shown in FIG. 6, as the propeller device 30 begins to translate rearwardly, the first portion of the exhaust gases 74 washes over the propeller device 30. The low pressure or suction on the first blade face 42 and on the first portion 64 of the propeller hub 32 draws a second portion of the exhaust gases 76 out of the exhaust vent holes 62, rearwardly of a majority of the propeller blades 40. This advantageously removes the first portion of the exhaust gases 74 from the path of travel of the propeller blades 40 and thereby enhances efficiency of the propeller device 30, especially at slower speeds. As shown, the increased pressure on the second portion 66 of the propeller hub 32 helps retain the exhaust gases in the through-bore 33 relative to the exhaust vent holes 60, more specifically causing the flow of exhaust gases to pass by and not escape from the through-bore 33 via the exhaust vent holes 62.

The present disclosure thus provides methods of discharging exhaust gas from a marine drive 10, including operating the powerhead 18 to cause reverse rotation of the propeller device 30, discharging a first portion 74 of the exhaust gases from the powerhead 18 to the water rearwardly of the propeller device 30 via the through-bore 33 and venting a second portion 76 of the exhaust gases from the powerhead 18 to the water forwardly of at least a majority of the propeller blades 40, thereby removing the second portion 76 of the exhaust gases from the path of travel of the reversely rotating propeller blades 40, thus enhancing reverse thrust of the propeller device 30, especially at slower speeds during joystick piloting operation.

Figure 7:
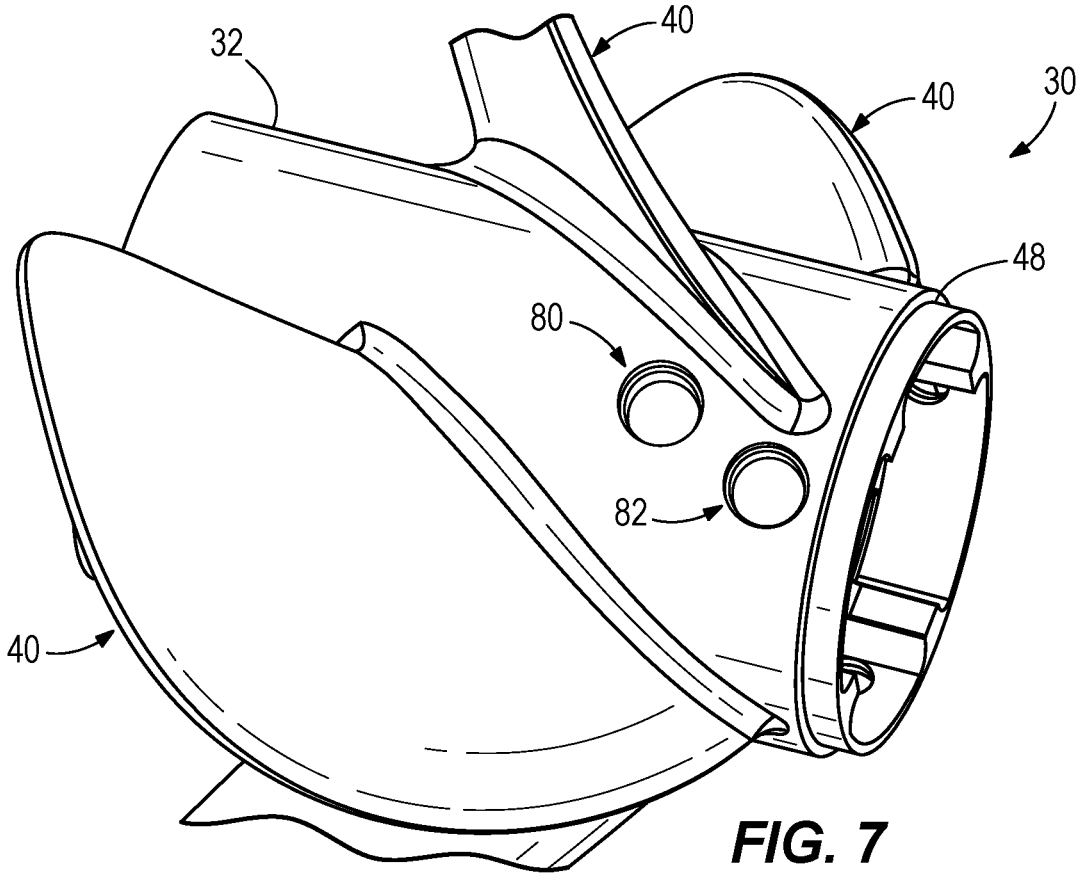
FIG. 7 is a starboard side perspective view of a second embodiment of the propeller device.
Figure 8:
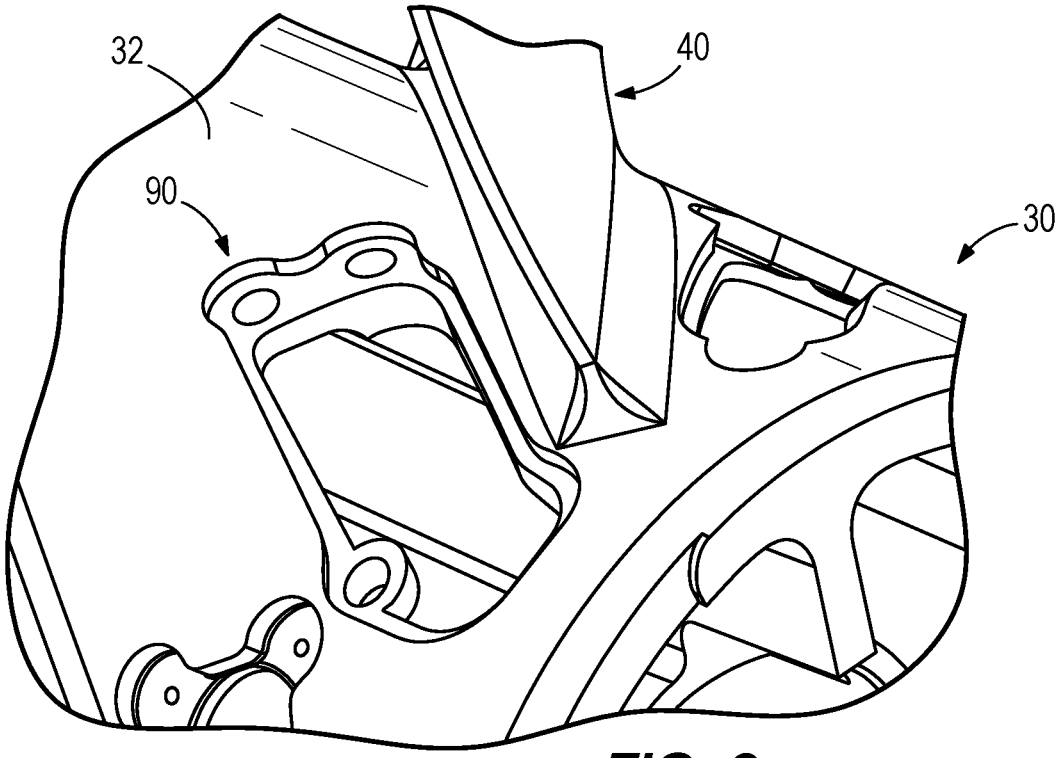
FIG. 8 is a starboard side view of a third embodiment of the propeller device.

As stated herein above, the number, location, and configuration (size and shape) of the exhaust vent holes can vary from what is shown. FIG. 7 depicts an alternate embodiment comprising a pair of exhaust vent holes 80, 82 which are circular and spaced apart from each other. The exhaust vent hole 82 is located closer to the trailing edge 48 of the propeller hub 32 than the exhaust vent hole 80. FIG. 8 depicts an alternate embodiment having an exhaust vent hole 90 that is oblong and configured to receive a removable cover (not shown), permitting the designer to selectively partially or completely cover the exhaust vent hole 90 depending upon performance objectives.

In addition to the above-described performance advantages provided by the novel propeller device 30, location of the exhaust vent holes (62, 80, 82, 90) on the propeller hub 32 advantageously improves the noise, vibration and harshness (NVH) characteristics of the marine drive 10 by locating the exhaust venting underwater.

Referring to FIG. 1, it is also possible to implement the novel propeller device 30 with a marine drive 10 having a conventional mechanical or electronic valve 100 configured to control flow of exhaust gases via the exhaust vent hole (62, 80, 82, 90). Opening and closing of the valve 100 optionally could be controlled by a computer controller 102 having programming and memory, for example as disclosed in the presently-incorporated U.S. patents. The controller 102 can be uniquely programmed to actively control the position of the valve 100 so as to intentionally permit flow of exhaust gases and/or a portion of the exhaust gases through the exhaust vent hole (62, 80, 82, 90) only under certain operating conditions of the marine drive 10 and/or based upon the operator's preferences. For example the valve 100 can be opened to allow flow of exhaust gases via the exhaust vent hole (62, 80, 82, 90) only during operation of a joystick to control the marine drive 10 and closed during other operating states wherein the joystick is not in use. Please also refer to the above-incorporated U.S. Pat. No. 7,762,772.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A propeller device that is forwardly and reversely rotatable about a rotational axis to propel a marine drive forwardly and reversely in water, respectively, the propeller device comprising:

a propeller hub which is elongated along the rotational axis;

a propeller blade which radially extends from the propeller hub, the propeller blade having a first blade face and an opposite, second blade face;

the propeller hub and propeller blade being configured so that when the propeller device is forwardly rotated, the first blade face encounters a positive pressure and the second blade face encounters a relatively lower pressure or suction, and further so that when the propeller device is reversely rotated, the second blade face encounters a positive pressure and the first blade face encounters a relatively lower pressure or suction; and an exhaust vent hole formed in the propeller hub alongside the first blade face, the exhaust vent hole being configured to vent exhaust gases from the marine drive via the propeller hub as the propeller device is reversely rotated, thereby enhancing reverse thrust performance of the propeller device.

2. The propeller device according to claim 1, wherein the propeller blade is one of a plurality of propeller blades that radially extends from the propeller hub, each propeller blade in the plurality of propeller blades having a respective first blade face and a respective opposite, second blade face; and wherein the exhaust vent hole is one of a plurality of exhaust vent holes that is interdigitated amongst the plurality of propeller blades, each exhaust vent hole in the plurality of exhaust vent holes being located alongside a respective first blade face of one of the plurality of propeller blades.

3. The propeller device according to claim 2, wherein each exhaust vent hole is located closer to the respective first blade face than a respective second blade face of an adjacent propeller blade of the plurality of propeller blades.

4. The propeller device according to claim 1, wherein the propeller hub has a forward end and a rearward end, and wherein the exhaust vent hole is closer to the forward end than the rearward end.

5. The propeller device according to claim 1, wherein the propeller blade comprises a leading edge and a trailing edge, wherein the leading edge is located forwardly of the trailing edge and wherein the exhaust vent hole is closer to the leading edge than the trailing edge.

6. The propeller device according to claim 1, wherein the propeller blade comprises a blade root on the propeller hub and a blade tip distally located relative to the blade root, and wherein the exhaust vent hole is located alongside the blade root.

7. The propeller device according to claim 6, wherein the blade root extends along a pitch line that is angled relative to the rotational axis, and wherein the exhaust vent hole is located forwardly of where the pitch line intersects with the rotational axis.

8. The propeller device according to claim 6, wherein the blade root has a forward root end and a rearward root end, and wherein the exhaust vent hole is closer to the forward root end than the rearward root end.

9. The propeller device according to claim 1, wherein the exhaust vent hole is circular.

10. The propeller device according to claim 1, wherein the exhaust vent hole is oblong.

11. The propeller device according to claim 1, wherein the exhaust vent hole is located at an area of lowest pressure or suction on the propeller hub when the propeller device is reversely rotated.

12. The propeller device according to claim 1, wherein the exhaust vent hole is located at an area of maximum pressure on the propeller hub when the propeller device is forwardly rotated.

13. The propeller device according to claim 1, wherein the exhaust vent hole is configured to vent the exhaust gases forwardly of a majority of the propeller blade as the propeller device is reversely rotated.

14. A propeller device that is forwardly and reversely rotatable about a rotational axis to propel a marine drive forwardly and reversely in water, respectively, the propeller device comprising:

a propeller hub which is elongated along the rotational axis;

a propeller blade which radially extends from the propeller hub;

the propeller hub and propeller blade being configured so that when the propeller device is forwardly rotated, a first portion of the propeller hub on a first side of the propeller blade encounters a positive pressure and a second portion of the propeller hub on an opposite, second side of the blade encounters a relatively lower pressure or suction, and further so that when the propeller device is reversely rotated, the second portion of the propeller hub encounters a positive pressure and the first portion of the propeller hub encounters a relatively lower pressure or suction; and an exhaust vent hole formed through the first portion of the propeller hub, the exhaust vent hole being configured to vent exhaust gases from the marine drive via the propeller hub as the propeller device is reversely rotated, thereby enhancing reverse thrust performance.

15. The propeller device according to claim 14, wherein the first portion of the propeller hub comprises an area of lowest pressure or suction on the propeller hub when the propeller device is reversely rotated, and wherein the exhaust vent hole is located at the area of lowest pressure or suction.

16. The propeller device according to claim 14, wherein the first portion of the propeller hub comprises an area of maximum pressure on the propeller hub when the propeller device is forwardly rotated, and wherein the exhaust vent hole is located at the area of maximum pressure.

17. The propeller device according to claim 14, wherein the exhaust vent hole is located on the propeller hub so that the exhaust gasses are vented from the exhaust vent hole forwardly of a majority of the propeller blade as the propeller device is reversely rotated.

18. A marine drive for propelling a marine vessel in water, the marine drive comprising:

a propeller device having a propeller hub which is elongated along a rotational axis and a propeller blade which radially extends from the propeller hub, the propeller hub and propeller blade being configured so that when the propeller device is forwardly rotated, a first portion of the propeller hub on a first side of the propeller blade encounters a positive pressure and a second portion of the propeller hub on an opposite, second side of the blade encounters a relatively lower pressure or suction, and further so that when the propeller device is reversely rotated, the second portion of the propeller hub encounters a positive pressure and the first portion of the propeller hub encounters a relatively lower pressure or suction; and a powerhead that causes rotation of a propeller device;

wherein a first portion of exhaust gases from the powerhead is discharged to the water via an elongated through-bore through the propeller hub and wherein a second portion of the exhaust gases from the powerhead is vented to the water via an exhaust vent hole formed through the first portion of the propeller hub, wherein the exhaust vent hole is configured such that the second portion of the exhaust gasses is vented forwardly from a majority of the propeller blade as the propeller device is reversely rotated, thereby enhancing reverse thrust performance of the propeller device.

19. The marine drive according to claim 18, wherein the first portion of the propeller hub comprises an area of lowest pressure or suction on the propeller hub when the propeller device is reversely rotated, and wherein the exhaust vent hole is located at the area of lowest pressure or suction.

20. The marine drive according to claim 18, wherein the first portion of the propeller hub comprises an area of maximum pressure on the propeller hub when the propeller device is forwardly rotated, and wherein the exhaust vent hole is located at the area of maximum pressure.

21. The marine drive according to claim 18, wherein the propeller blade comprises a leading edge and a trailing edge, wherein the leading edge is forwardly of the trailing edge, and wherein the exhaust vent hole is closer to the leading edge than the trailing edge.

22. A method of discharging exhaust from a marine drive, the method comprising:

providing a propeller device having a propeller hub which is elongated along a rotational axis and a propeller blade which radially extends from the propeller hub, the propeller hub and propeller blade being configured so that when the propeller device is forwardly rotated, a first portion of the propeller hub on a first side of the propeller blade encounters a positive pressure and a second portion of the propeller hub on an opposite, second side of the blade encounters a relatively lower pressure or suction, and further so that when the propeller device is reversely rotated, the second portion of the propeller hub encounters a positive pressure and the first portion of the propeller hub encounters a relatively lower pressure or suction; and operating a powerhead to cause reverse rotation of the propeller device;

discharging a first portion of exhaust gases from the powerhead to the water rearwardly of the propeller device via a through-bore in the propeller device and venting a second portion of the exhaust gases from the powerhead to the water forwardly of at least a majority of the propeller blade, thereby enhancing reverse thrust of the propeller device.

23. The method according to claim 22, further comprising venting the second portion of the exhaust gases at an area of lowest pressure or suction on the propeller hub when the propeller device is reversely rotated.

24. The method according to claim 22, further comprising venting the second portion of the exhaust gases at an area of maximum pressure on the propeller hub when the propeller device is forwardly rotated.

25. The method according to claim 22, wherein the propeller blade comprises a leading edge and a trailing edge, wherein the leading edge is forwardly of the trailing edge, and further comprising venting the second portion of the exhaust gases at a location closer to the leading edge than the trailing edge.

* * * * *